US009468254B2

(12) United States Patent
Chaiken

(10) Patent No.: US 9,468,254 B2
(45) Date of Patent: Oct. 18, 2016

(54) COMPACT SHOE WARDROBE SYSTEM IMPLEMENTING INTERCHANGEABLE VAMPS AND BASES

(71) Applicant: Albert Chaiken, New York, NY (US)

(72) Inventor: Albert Chaiken, New York, NY (US)

( * ) Notice: Subject to any disclaimer, the term of this patent is extended or adjusted under 35 U.S.C. 154(b) by 0 days.

(21) Appl. No.: 14/478,850

(22) Filed: Sep. 5, 2014

(65) Prior Publication Data

US 2015/0181980 A1 Jul. 2, 2015

Related U.S. Application Data

(63) Continuation-in-part of application No. 13/312,878, filed on Dec. 6, 2011, now abandoned.

(51) Int. Cl.
*A43B 3/24* (2006.01)

(52) U.S. Cl.
CPC ..... *A43B 3/244* (2013.01); *A43B 3/242* (2013.01)

(58) Field of Classification Search
CPC ..... A43B 5/24; A43B 5/242; A43B 5/244; A43B 5/246
USPC ..... 36/11.5, 15, 100, 101
See application file for complete search history.

(56) References Cited

U.S. PATENT DOCUMENTS

| | | | | |
|---|---|---|---|---|
| 2,065,531 | A | 12/1936 | Kerr | |
| 2,319,497 | A * | 5/1943 | Franklin | 190/16 |
| 2,368,314 | A | 1/1945 | Marx | |
| 2,519,108 | A | 8/1950 | Bryant et al. | |
| 2,552,943 | A | 5/1951 | Danielius | |
| 2,583,826 | A | 1/1952 | Fischer | |
| 2,761,224 | A | 9/1956 | Gardiner | |
| 2,809,449 | A | 10/1957 | Smith | |
| 2,887,795 | A | 5/1959 | Taicher | |
| 3,032,896 | A | 5/1962 | Weaver | |
| 3,204,346 | A | 9/1965 | Lockard | |
| 4,363,177 | A | 12/1982 | Boros | |
| 4,366,633 | A | 1/1983 | Flottorp | |
| 4,439,935 | A | 4/1984 | Kelly | |
| 4,753,329 | A * | 6/1988 | Choy | 190/111 |
| 4,887,369 | A | 12/1989 | Bailey et al. | |
| 4,967,986 | A * | 11/1990 | Schildkraut | 224/250 |
| 5,065,531 | A | 11/1991 | Prestridge | |
| 7,028,420 | B2 | 4/2006 | Tonkel | |
| 7,318,289 | B2 | 1/2008 | Chan | |
| 7,465,092 | B2 | 12/2008 | Hsu et al. | |
| 7,650,704 | B2 * | 1/2010 | Richardson | 36/11.5 |
| 7,661,206 | B2 * | 2/2010 | Osborn | 36/101 |

(Continued)

*Primary Examiner* — Khoa Huynh
*Assistant Examiner* — Sharon M Prange
(74) *Attorney, Agent, or Firm* — Blynn L. Shideler; Krisanne Shideler; BLK Law Group

(57) ABSTRACT

A compact shoe wardrobe system implementing interchangeable vamps and bases comprises a plurality of bases, wherein rear portions of the plurality of bases include heels of different heights, such as a pair of flats, a pair of high heels and a pair of intermediate heels. Each base includes a ground engaging outer-sole and a support plate secured atop of the outer-sole on a forward portion of the base. Each support plate forms a pair of elongate channels defined on opposed side edges of the support plate, and an access opening on one end of the elongate channels and wherein the elongate channels are closed on the opposed end. The system includes a plurality of distinctly styled vamps selectively coupled to each base, each vamp including a pair of elongated channel-engaging members configured to slide into and mate with a respective one of the elongated channels of an associated base.

14 Claims, 11 Drawing Sheets

(56) References Cited

U.S. PATENT DOCUMENTS

| | | | | |
|---|---|---|---|---|
| 7,681,332 | B2 | 3/2010 | Allen | |
| 7,698,834 | B1 | 4/2010 | Courville | |
| 2003/0233772 | A1* | 12/2003 | Musial | 36/100 |
| 2005/0066549 | A1* | 3/2005 | Grivas | 36/101 |
| 2008/0098623 | A1 | 5/2008 | Komitau | |
| 2009/0193684 | A1* | 8/2009 | Diamond | 36/101 |
| 2013/0139408 | A1 | 6/2013 | Chaiken | |

* cited by examiner

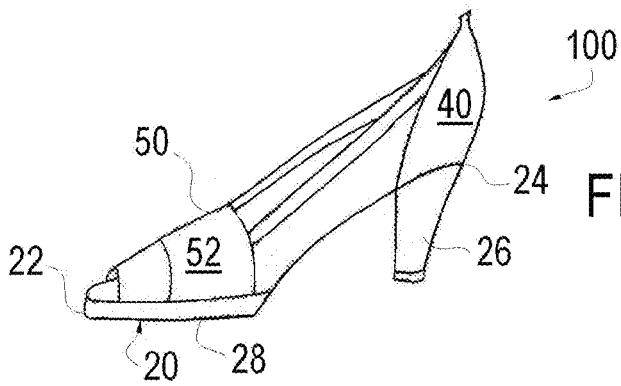
FIG. 2B
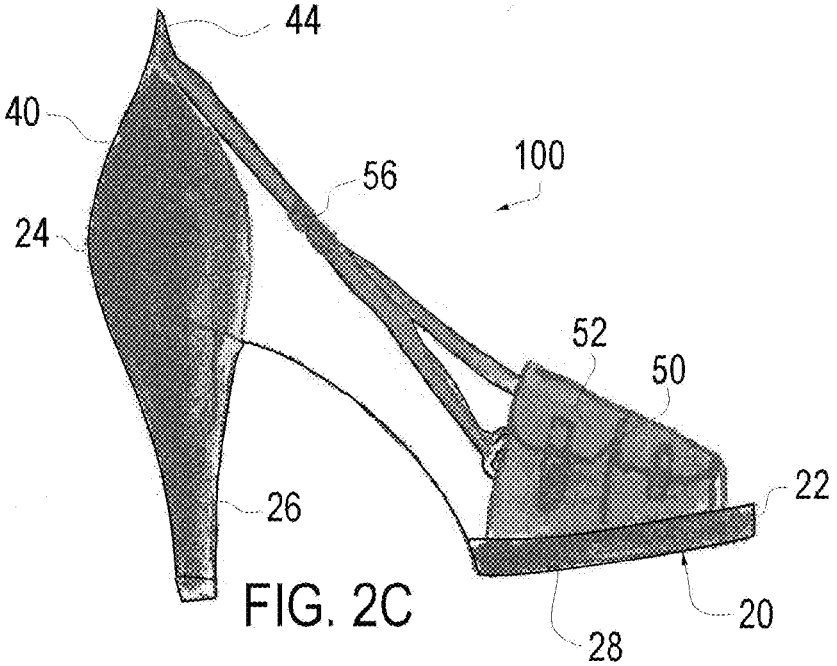
FIG. 2C
FIG. 2A
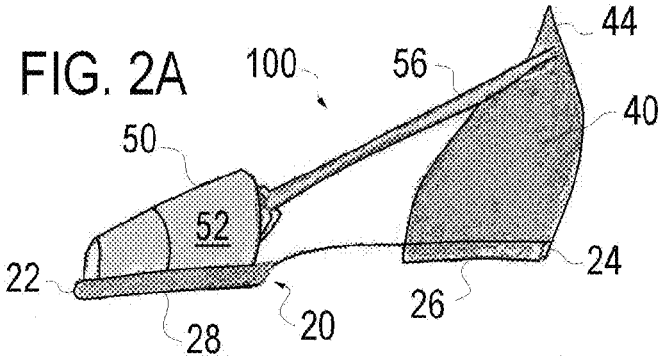

FIG. 7B
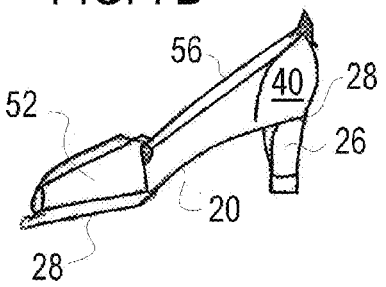
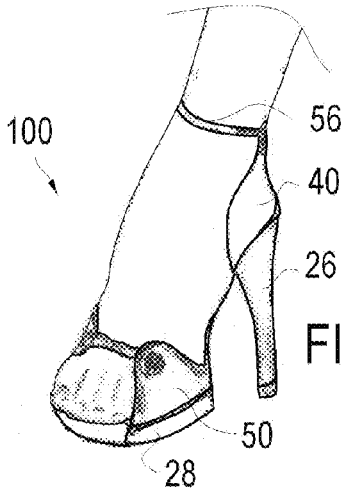
FIG. 6B
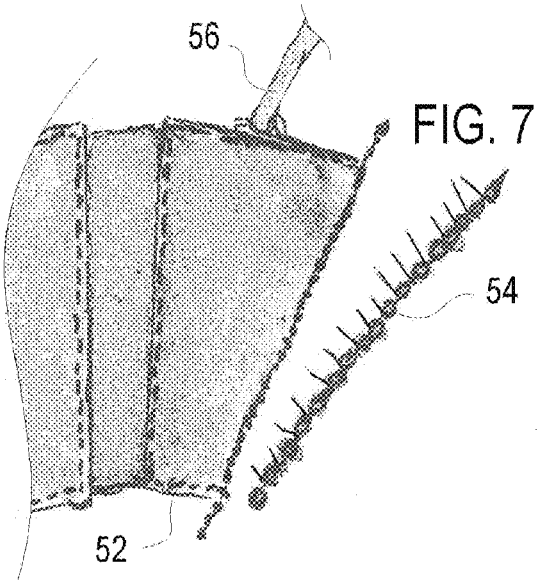
FIG. 7C
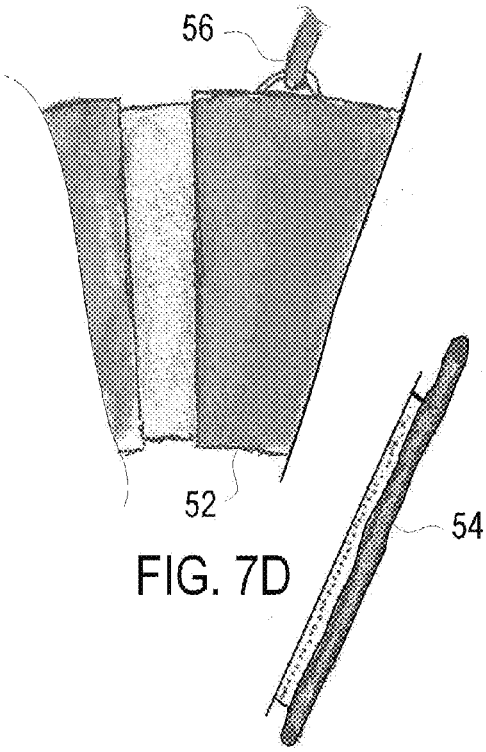
FIG. 7D
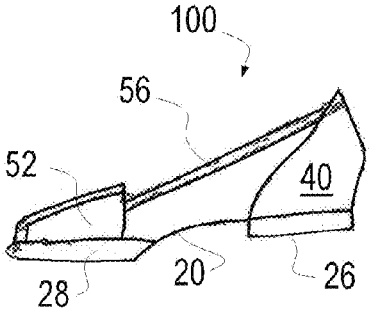
FIG. 7A FIG. 6D
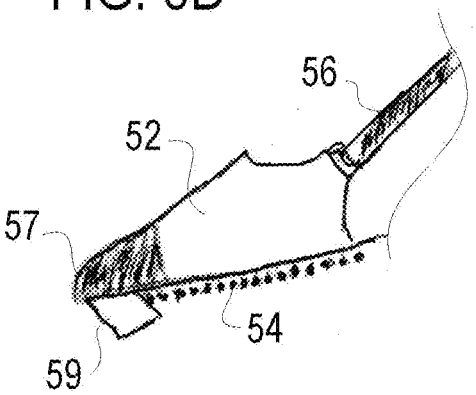
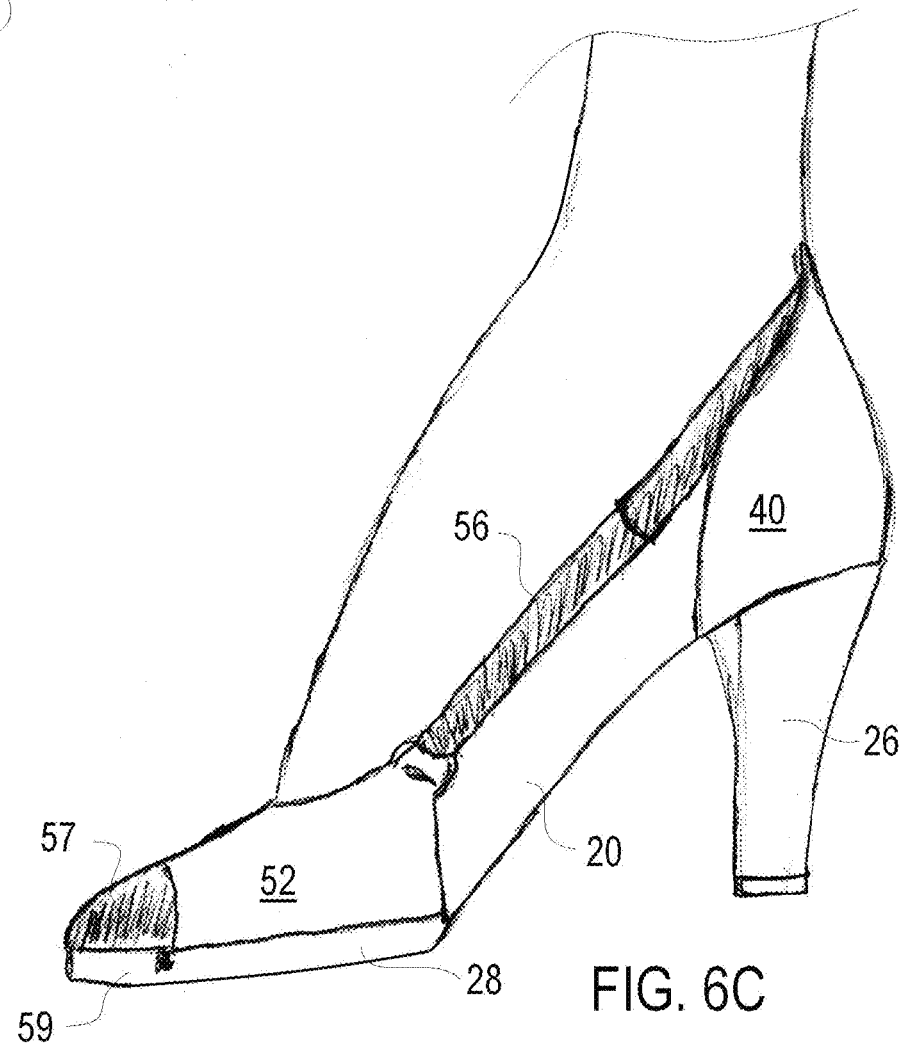
FIG. 6C

COMPACT SHOE WARDROBE SYSTEM IMPLEMENTING INTERCHANGEABLE VAMPS AND BASES

RELATED APPLICATIONS

This application claims is a Continuation in Part of U.S. patent application Ser. No. 13/312,878 filed Dec. 6, 2011, now abandoned, entitled "Shoe with Multiple Selectable Vamps" which published Jun. 6, 2013 as publication 2013-0139408 and which publication is incorporated herein by reference in its entirety.

BACKGROUND INFORMATION

1. Field of the Invention

The present invention relates to women's shoes and more particularly to a compact, expandable system for providing women with a desired complete line of footwear implementing interchangeable vamps and bases.

2. Background Information

Today, increasingly high standards for physical appearance in terms of style, clothing and the like have increased the need for a person to dress in a coordinated and stylish fashion. Thus, a person may require a great number of different types of various clothing.

Shoes, particularly women's shoes, have both functional characteristics and design characteristics. Functional characteristics include heel height and shape and the nature of the back of the shoe, i.e. whether open-back, sling-back or closed back. Design characteristics include color, material, and decorative elements such as buckles, piecing, stitching or other ornamental features. Matching both the functional and design characteristics of women's dress, business or fashion leisure shoes with women's dress, business or fashion leisure clothing can be difficult. Some occasions allow for an open toe configuration while others call for closed-toe shoes.

Thus providing a full wardrobe of shoes has proven to be expensive and challenging. The problem is multiplied in the case of travel, where multiple shoes to accommodate the distinct business and social environments expected in even a short trip often presents a relatively large burden during transport, particularly during onboard storage. Thus, traveling light is historically almost not an option for women who wish to have a reasonable range of shoes.

The prior art has made some attempts to increase the versatility of a single shoe through designs that provide for a single shoe base or heel with a series of interchangeable vamps or uppers. However, prior attempts to provide an interchangeable vamp or upper have often produced bulky or complex mechanisms unsuited for women's dress shoes.

For example, U.S. Pat. No. 2,809,449, which is incorporated herein by reference, discloses an upper attached to the sole with a zipper-like slide fastener, which is generally unsuited for women's dress shoes.

Similarly, U.S. Pat. No. 2,761,224, which is incorporated herein by reference, discloses a shoe with a hollow welt for a detachable upper, where the connecting mechanism is embedded into the welt and sole of the shoe, resulting in a thick sole and protruding welt.

U.S. Pat. No. 4,363,177, which is incorporated herein by reference, a channel inserted within the shoe base that does not make any provision for a closed toe and that requires a thick sole.

U.S. Pat. No. 4,439,935, which is incorporated herein by reference, discloses a convertible shoe upper comprised of an insole and vamp unit construction with a hook and loop fastener, a resulting design suitable only for a sandal.

U.S. Pat. No. 7,028,420, which is incorporated herein by reference, discloses a limited sandal-type shoe with a slot into which a reversible vamp is inserted.

U.S. Pat. No. 7,698,834, which is incorporated herein by reference, discloses a shoe with an interchangeable vamp in which the shoe base has a rim piece on the outer edge of the shoe base that interlocks with a protruding lip on the outer edge of the vamp except in the toe area, where the rim piece and vamp abut one another rather than interlocking, allowing the interchangeable vamp to have a closed toe.

Other prior art provides for certain design elements to be interchangeable, but the disclosed interchangeable device does not comprise the entire vamp or upper section, limiting the design characteristics that can be interchanged. For example, U.S. Pat. No. 2,887,795 discloses an interchangeable design element that is attached to the top of the vamp of the shoe. Similarly, in U.S. Pat. No. 2,583,826 discloses a system of interchangeable panels in a vamp, but the entire vamp is not interchangeable. U.S. Pat. No. 3,032,896 discloses a backless sandal with an arcuate vamp cover snapped to the shoe base. In addition to being suitable only for an open-toe shoe, the snapping mechanism prevents the shoe from having the sleek appearance necessary for women's dress shoes.

It is an object of the present invention to address these deficiencies of the existing prior art and to provide a cost effective, efficient, compact, expandable, shoe wardrobe system.

SUMMARY OF THE INVENTION

This invention is directed to a cost effective, efficient, compact, expandable, shoe wardrobe system implementing interchangeable vamps and bases comprising: a) a plurality of bases, wherein each base includes a forward portion terminating at a toe end, a rear portion terminating at a heel end, wherein said rear portion of said plurality of bases including heels of different heights, such as a pair of flats, a pair of high heels and a pair of intermediate heels, and wherein each base includes an outer-sole configured to come into contact with the ground, and a support plate secured atop of the outer-sole on a forward portion of the base, wherein each support plate forms a pair of elongate channels defined on opposed side edges of the support plate, and an access opening on one end of the elongate channels and wherein the elongate channels are closed on the opposed end; and b) a plurality of distinctly styled vamps configured to overlie the instep of the user and configured to be selectively coupled to each base, each vamp including a pair of elongated channel-engaging members on the sides of the vamp, each channel engaging member configured to slide into and mate with a respective one of the elongated channels of an associated base.

These and other aspects of the present invention will be clarified in the description of the preferred embodiment of the present invention described below in connection with the attached figures in which like reference numerals represent like elements throughout.

BRIEF DESCRIPTION OF THE DRAWINGS

FIGS. 2A-C schematically illustrate the low heel or flat base, the intermediate heel base and the high heel base for use in the shoe wardrobe system of FIGS. 1A-B;

FIG. 6B schematically illustrates a perspective view of a shoe using one base and one vamp of the shoe wardrobe system according to the present invention;

FIG. 6C schematically illustrates a perspective view of a shoe using one base and one vamp of the shoe wardrobe system according to the present invention;

FIG. 6D schematically illustrates a perspective view of vamp of FIG. 6C;

FIGS. 7A and B schematically illustrate side elevation views of two shoes using distinct bases and one vamp of the shoe wardrobe system according to the present invention;

FIG. 7C schematically illustrated an exploded view of a portion of the vamp of the shoe of FIGS. 7A and B;

FIG. 7D schematically illustrated an exploded view of a portion of the vamp with an alternative coupling of the shoe of FIGS. 7A and B;

DESCRIPTION THE PREFERRED EMBODIMENTS

Figure 1B:
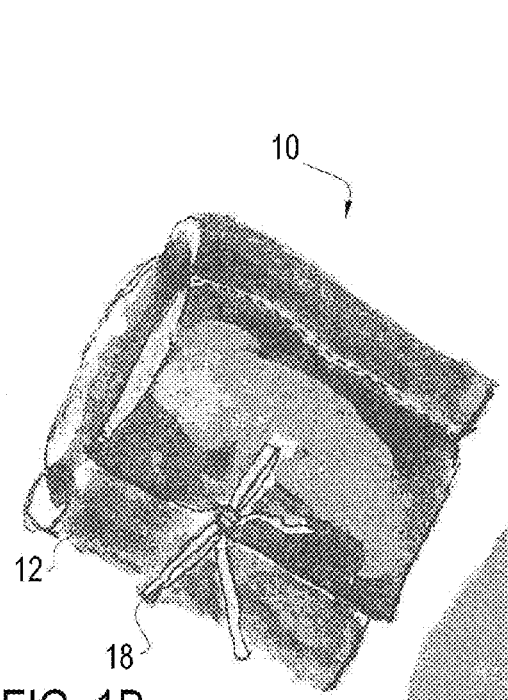
FIG. 1B schematically illustrates the compact shoe wardrobe system of FIG. 1A within the flexible tote in a transport position.
Figure 1A:
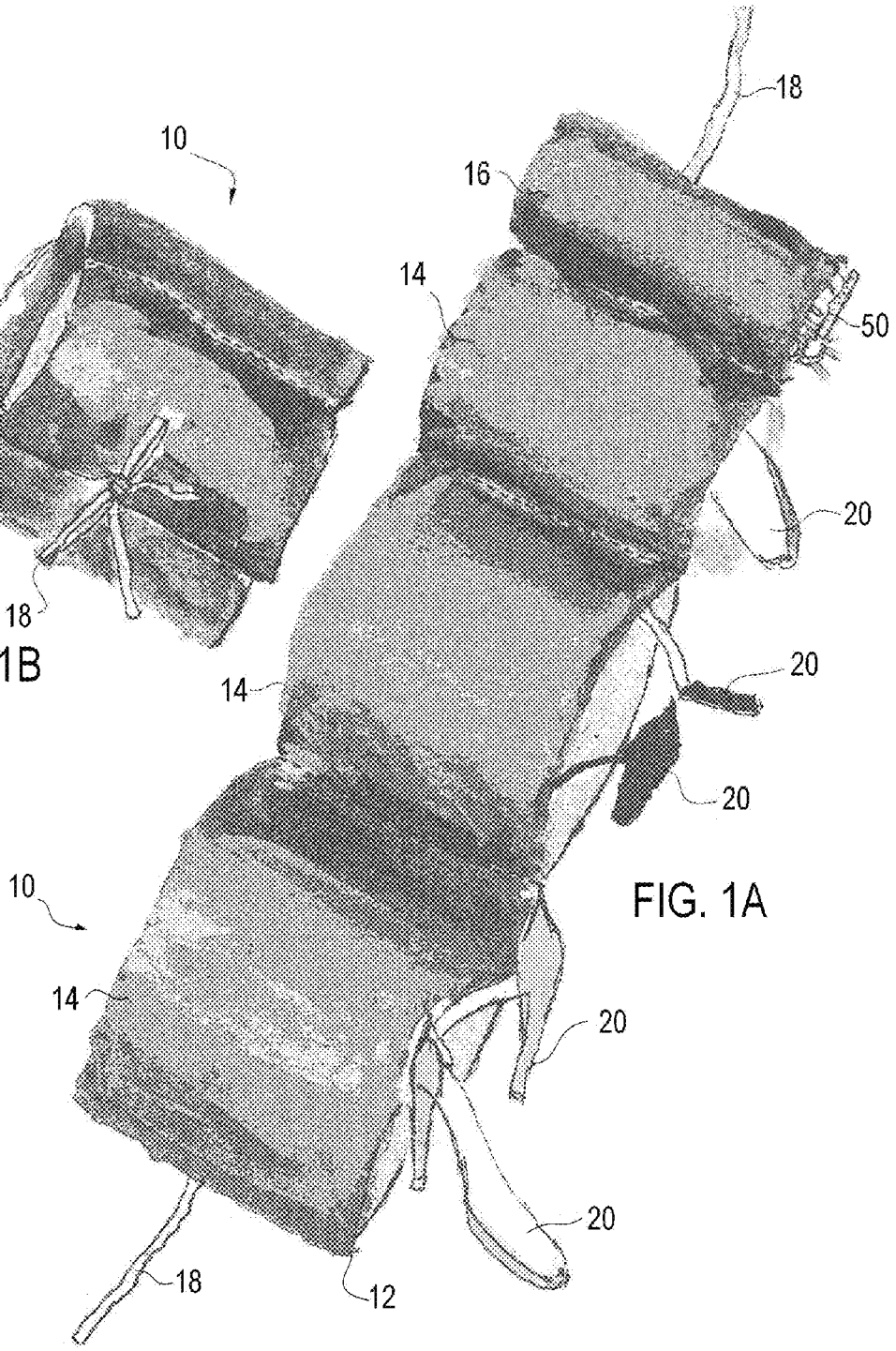
FIG. 1A schematically illustrates the compact shoe wardrobe system within a flexible tote of the system according to one aspect of the present invention.
Figure 3A:
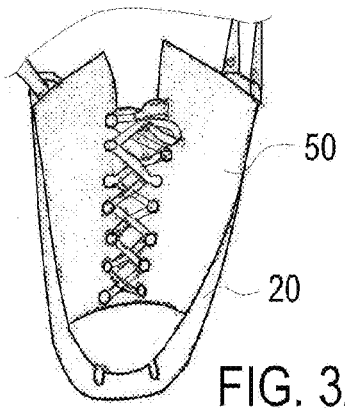
FIGS. 3A-E schematically illustrate a top plan view of a variety of alternative vamp designs for use in the shoe wardrobe system of FIGS. 1A-B.
Figure 3B:
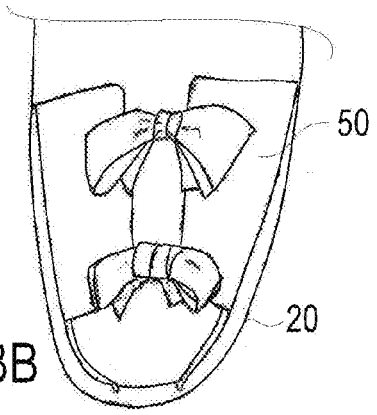
Figure 3C:
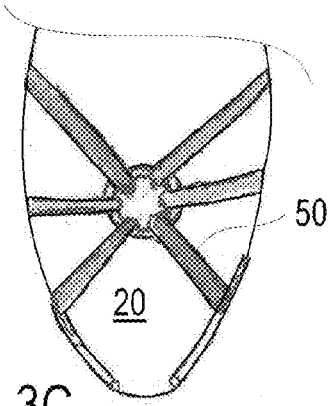
Figure 3D:
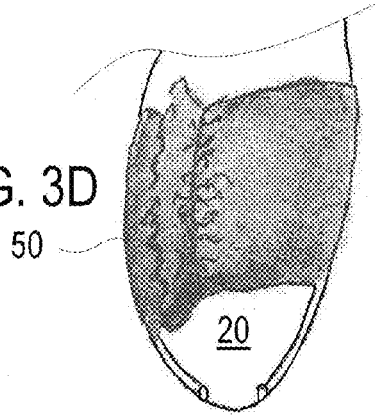
Figure 3E:
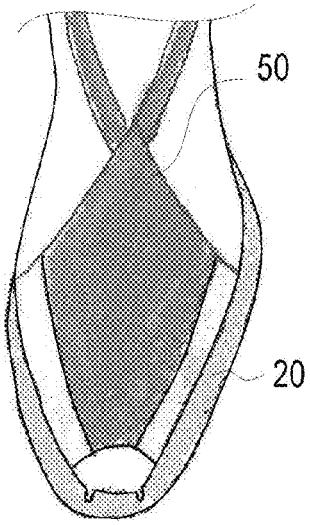

FIG. 1A schematically illustrates the compact shoe wardrobe system 10 implementing interchangeable vamps 50 and bases 20 within a flexible tote 12 of the system 10 according to one aspect of the present invention. The tote 12 includes a plurality of base compartments 14 each holding a distinct pair of bases 20 (described below), and at least one vamp compartment 16 holding a plurality of vamps (described below). The flexible tote 12 is configured to be rolled up as shown in FIG. 1B for transport of the system 10 with ties 18 on the end compartments (14 or 16) to secure the tote 12 in the compacted position.

The tote 12 can be formed as generally known in the art out of fabric sufficient to receive and protect the components (bases 20 and vamps 50). The compartments 12, 14 may have closures to secure them such as flaps or zippers or the like. Additionally the compartments 12 and 14 may be formed to be selectively attached to adjacent compartments 12 and 14, such as through a zipper, to allow for additional compartments 12 or 14 to be added to the tote 12 to allow for expansion of the tote 12.

As described in greater detail below the system 10 includes a plurality of pairs of bases 20, wherein each base 20 includes a forward portion terminating at a toe end 22, a rear portion terminating at a heel end 24, wherein said rear portion of said plurality of bases 20 including heels 26 of different heights, and wherein each base includes an outer-sole 28 configured to come into contact with the ground, and a support plate 30 secured atop of the outer-sole on a forward portion of the base 20, wherein each support plate 30 forms a pair of elongate channels 32 defined on opposed side edges of the support plate 32, and an access opening 34 on one end of the elongate channels 32 and wherein the elongate channels 32 are closed on the opposed end; and b) a plurality of distinctly styled vamps 50 with tops 52 configured to overlie the instep of the user and the vamps 50 configured to be selectively coupled to each base 20, each vamp 50 including a pair of elongated channel-engaging members 54 on the sides of the vamp, each channel engaging member 54 configured to slide into and mate with a respective one of the elongated channels 32 of an associated base 20.

The term wardrobe as used herein is referencing "a collection of clothes for a particular season or purpose", whereby the shoe wardrobe system of the invention provides components to form a related collection of shoes 100 for the user. Specifically the vamps 50 of each system 10 are configured to be utilized with each pair of bases 20 of the system 10 to provide a unique individual shoe 100 for the user. The bases 20 of the system 10 are provided for varied utility of the associated shoe 100. For example, as shown, the system 10 provides a pair of bases 20 formed as flats that are defined by low or no heel, that may be particularly useful for walking to work in a city environment; the system 10 provides a pair of bases 20 formed as medium height heels, that may be appropriate for a business attire; and the system 10 provides a pair of bases 20 formed as high heels, that may be appropriate for formal attire. FIG. 2A schematically illustrates the low heel 26 or flat base 20 (for forming "flats"), FIG. 2B schematically illustrates the base 20 with the intermediate heel (e.g. for business or casual attire), and FIG. 2C schematically illustrates the base 20 with the high heel 26 (e.g., for formal attire) for use in the shoe wardrobe system of FIGS. 1A-B. Thus a single pair of vamps 50 will yield three related but distinct shoes 100 for the user, all of which may be deemed appropriate in an ordinary day. In addition, multiple designs for vamps 50 will significantly increase the available shoes 100. In a limited example, seven styles of vamps 50 with merely three bases 50 as identified will yield over 20 distinct shoes 100 for the user, which can be transported by the user the equivalent or even less space than would be taken up with transporting three conventional pairs of shoes.

In addition to the advantages to the user the system 10 of the present invention provides substantial benefits to the retailer and the manufacturer as well. A retailer of conventional shoes often must dedicate a large amount of inventory space so that all styles are available in a range of conventional sizes. In contrast a retailer of the system 10 can display and sell a large variety of shoes 100 with a fraction of the retail space. The system 10 allows a whole shoe store to be accommodated in a small area allowing clothing stores, even small boutique stores, to expand into the selling of accessories in the form of shoes 100 using the system 10.

The manufacturer will see a significant improvement through a decrease in their shipping costs. Further the manufacturer can again sell to prior customers of the system 10 through adding new bases 20 or vamps 50 for a given system 10. For the manufacturers it is anticipated that the present invention will be implemented in separate lines of large systems 10 (e.g. the DIAMOND™ line, the SPIRIT™ line and the MIDNIGHT™ line) wherein vamps 50 and or bases 20 will be introduced as appropriate for one or more of the lines, but not likely ALL the lines or systems 10. The manufacturer may market all lines or systems 10 under a common brand, such as SHOERADE™ used by the applicant. The user may only purchase a few bases 20 and vamps 50 within a given line or system 10. It is possible that a given user desires only one shoe 100 and thus only purchases a single pair of bases 20 and vamps 50, but many of the advantages of the system 10 will not be available to the user until she purchases more bases 20 and possibly more vamps. The real advantage of the system 10 is with a plurality of bases 20 and a plurality of vamps 50 to form the multiple shoes 100.

The construction of the individual bases 20 and vamps 50 is repeated below but is also described in parent application Ser. No. 13/312,878, which published as 2013-0139408, and which is incorporated herein by reference. In accordance with the invention, the individual shoes 100 formed by system 10 are of relatively lightweight and compact construction, while at the same time capable of exhibiting various appearances. The inventive shoe 100 is also advantageous for reasons of its economy, sturdy construction and convenience.

In accordance with the invention, a shoe 100 formed in the system 10 has a base 20 for supporting and protecting the heel, sole and toes of a human foot. The base 20 comprises a forward portion terminating at a toe end 22 with the forward portion being configured and dimensioned to support the sole and toes of the foot of a user. The rear portion terminates at a heel end 24, with the rear portion being configured and dimensioned to support the heel of the foot of the user.

As noted above the base 20 of the shoe 100 comprises a pair of elongated channels 32 formed or defined by plate 30 in the forward portion of the base 20.

A vamp 50 is configured to have a top member 52 overlie the instep of the user, and a pair of elongated channel-engaging members 54 secured to the vamp 50 with each of the channel engaging members 54 being configured to slide into and mate with a respective elongated channel 32 through opening 34. The opposed ends of the channels 32 may be closed to secure the vamp 50 in the shoe 100 in use, as the users foot will act to keep the vamp 50 from moving back through the channel 32. A catch or detent member could also be used at the opening 34 to further secure the member 54 in position with the user's foot in the shoe 100.

The shoe 100, depending upon design, may further comprise an enclosed back part or heel 40 is secured to the rear portion of the base 20 to fully contain and support the heel/ankle of a human foot. The base 20 includes a ground engaging outer sole 28, or just sole, that may conventionally be a leather, plastic or rubber-like member defining the toe end (and the heel 26 may include a heel cap of similar construction), and a support plate 30 secured to the forward portion of the base 20. The support plate 30 may be easily and effectively formed of a metal, with the left and right support plate sides being configured to define a edge which forms the elongated channels 32.

Figure 8A:
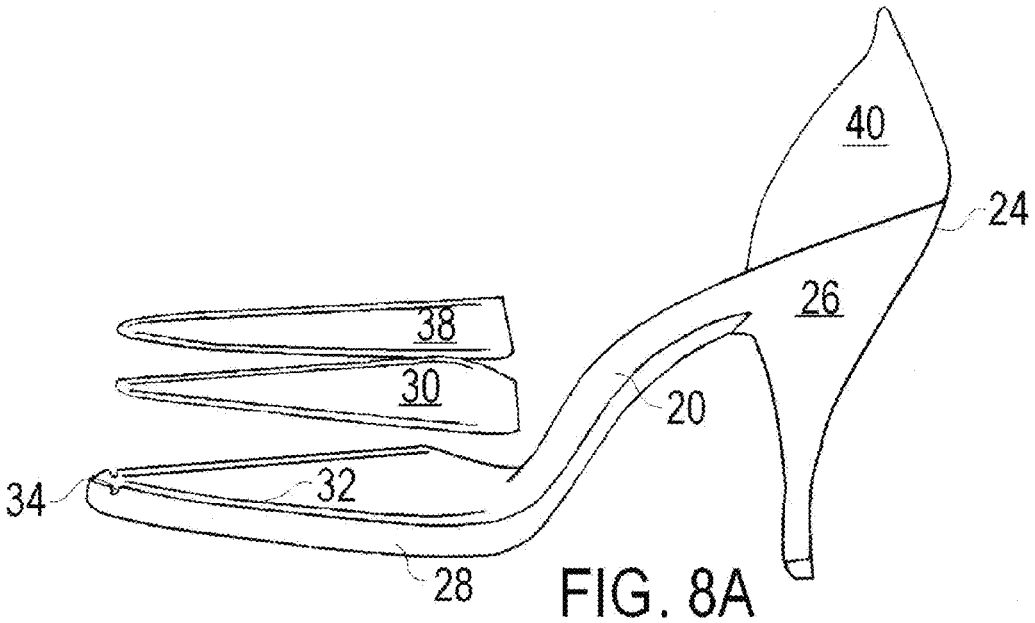
FIG. 8A schematically illustrates an alternative base for use in the shoe wardrobe system according to the present invention.
Figure 8B:
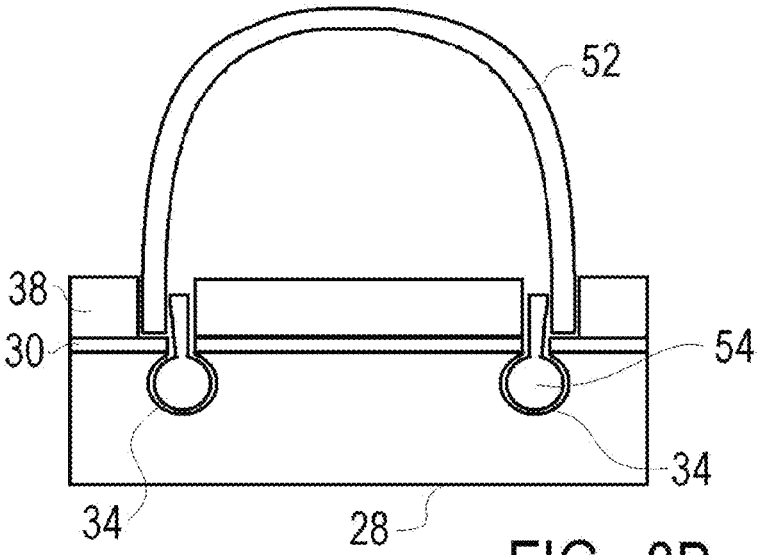
FIG. 8B schematically illustrates a cross section of the vamp and the alternative base of FIG. 8A.
Figure 8C:
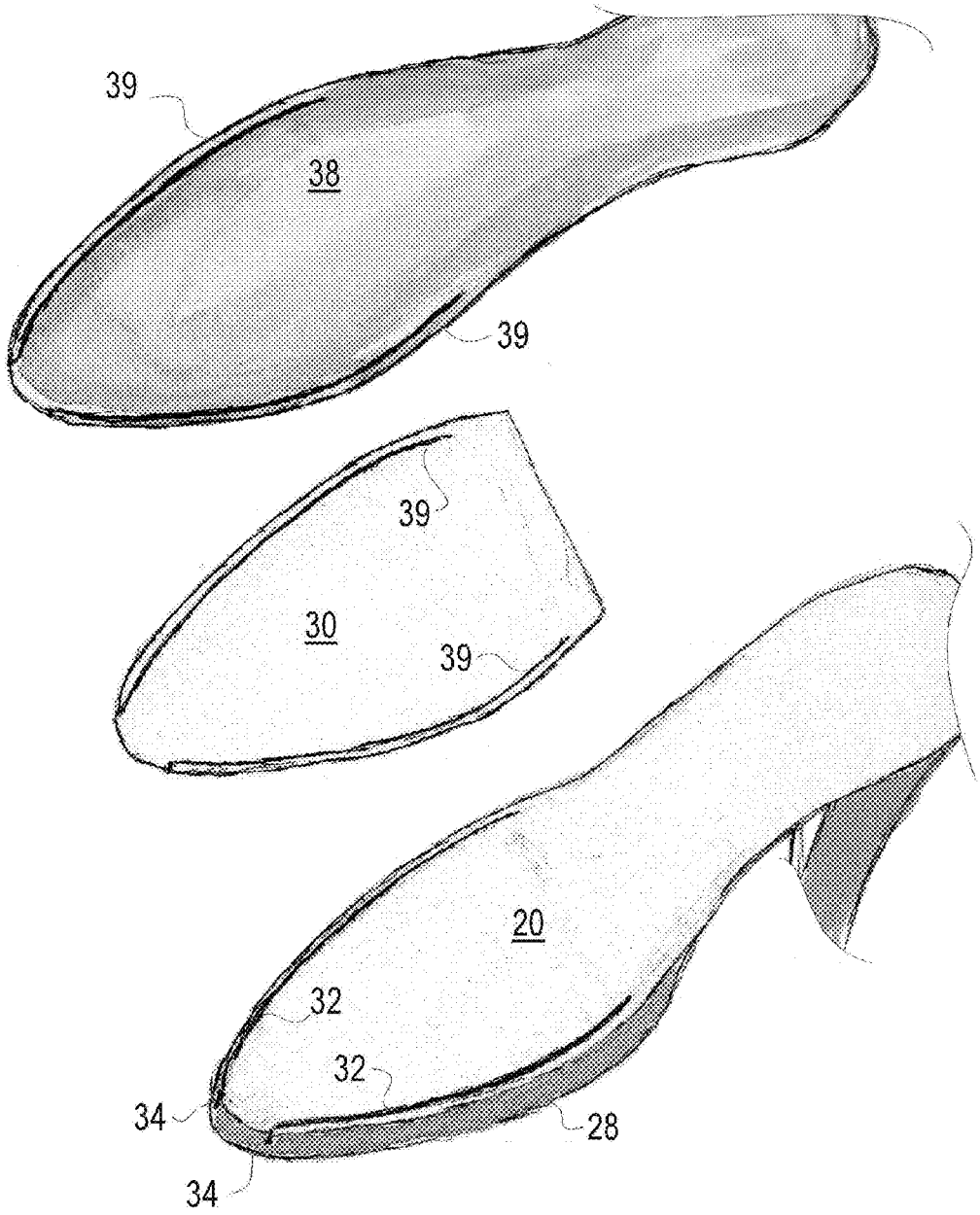
FIG. 8C schematically illustrates and exploded view of the base of FIG. 8A.

Alternatively as shown in FIG. 8, the support plate 30 comprises a metal, with two slits 39 open at the forward portion each having a closed end at the rear portion. The base 20 below the plate 30 in sole 28 having circular, elongated channels open at 34 at the forward portion and closed at the rear portion. These slits 39 in the plate 30 define, together with the circular, elongated channels in the sole 28, form the channels 32 and accommodate the channel-engaging members 54 secured to the vamp 50. Other support plate 30 configurations could be used to form the channels 32 with forward opening 34, if desired, but the embodiments shown are preferred for simplicity and effectiveness.

An insole 38 mounted on top of the support plate 30 to provide cushioning for the foot and also acting as a shock absorber against the forward moving motion of the person wearing the shoe 100 and the insole 38 may have aligned slits 39 in certain embodiments.

The elongated channel-engaging members 54 are stitched to the vamp 50 as shown. Each vamp 50 generally comprises a flexible member or decorative panel 52 having a forward edge, a rear edge, a left side edge and a right side edge. The elongated channel-engaging members each preferably comprise a series of separate balls (forming a ball chain) each being secured to the side edges of the vamp 50 to provide a secure and flexible attachment.

The panels 52 of the vamps 50 may be made of materials such as leather, fabric or plastic that can accommodate the channel-engaging member 54. A strap 56 may be attached to the counter 40 via loops 44, merely for decorative appeal and/or to securely hold the ankle of a human foot and provide further stability to counter against forces associated with walking or other similar activities. The strap 56 may also be designed to go around the ankle without attachment to the counter or heel 40, such as in the low heel or no heel design (i.e. the flats). Further some vamps 50 may have the strap as removeable such that the strap 56 is used selectively as desired. The figures also show the strap 56 may only be secured to the counter 40 in some designs, making the vamp a two piece structure in that design.

Figure 4A:
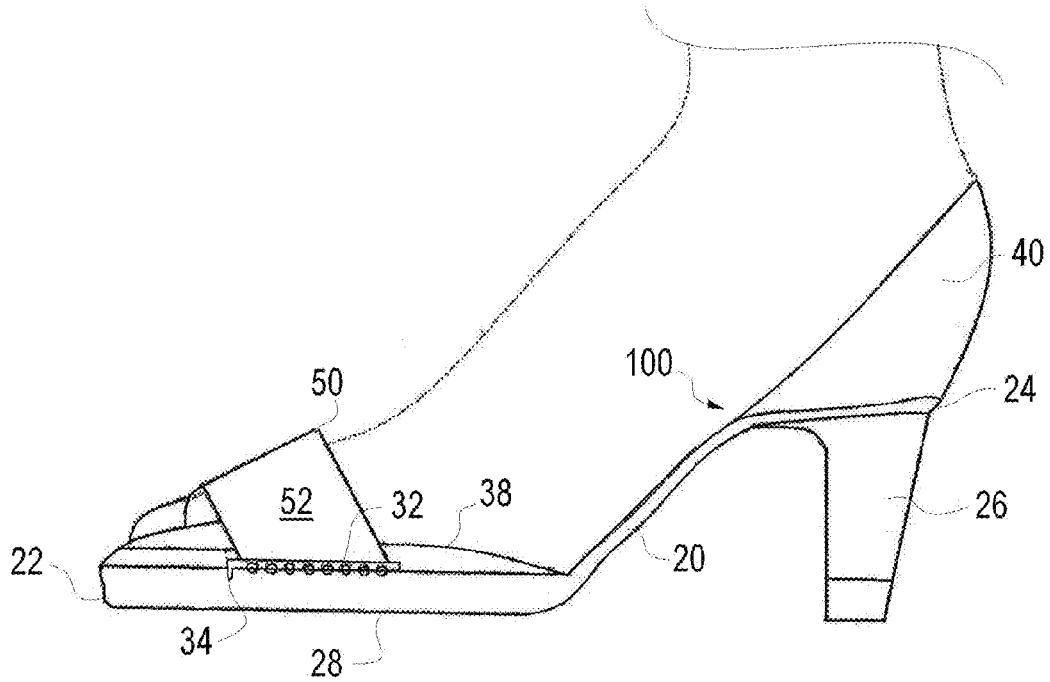
FIG. 4A schematically illustrates a side elevation view of a shoe using one base and one vamp of the shoe wardrobe system according to the present invention.

Referring to FIGS. 4A and B, the inventive shoe 100 of the system 100 comprises a removable front section or vamp 50 that covers much of the front end of a foot. Removable front section or vamp 50 can be made up of any suitable material or materials such as leather or fabric. Other alternatives include fabric with embroidery, plastic, fabric supporting jewels, and exotic papers. If desired materials such as textiles, papers and the like may be treated with suitable substances to improve their longevity and serviceability, such as waterproof coatings and the like. A number of styles of vamps 50 are shown in the figures particularly in FIGS. 3A-E.

Figure 4B:
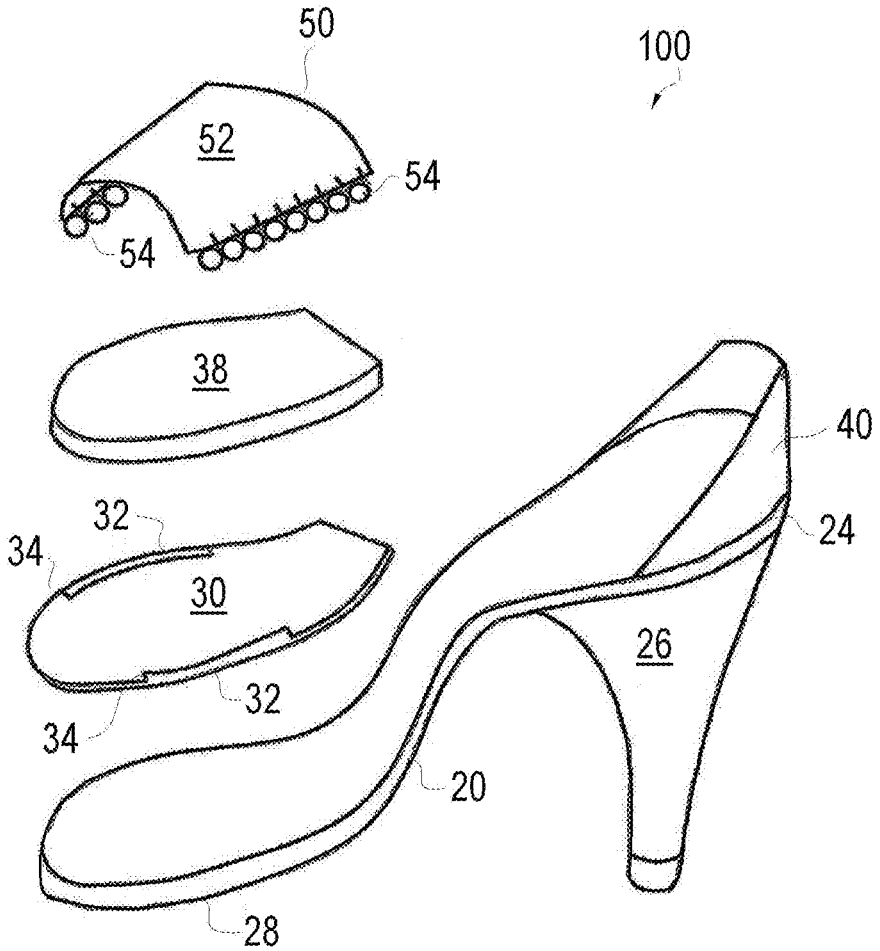
FIG. 4B schematically illustrated a perspective exploded view of the shoe of FIG. 4A.
Figure 5A:
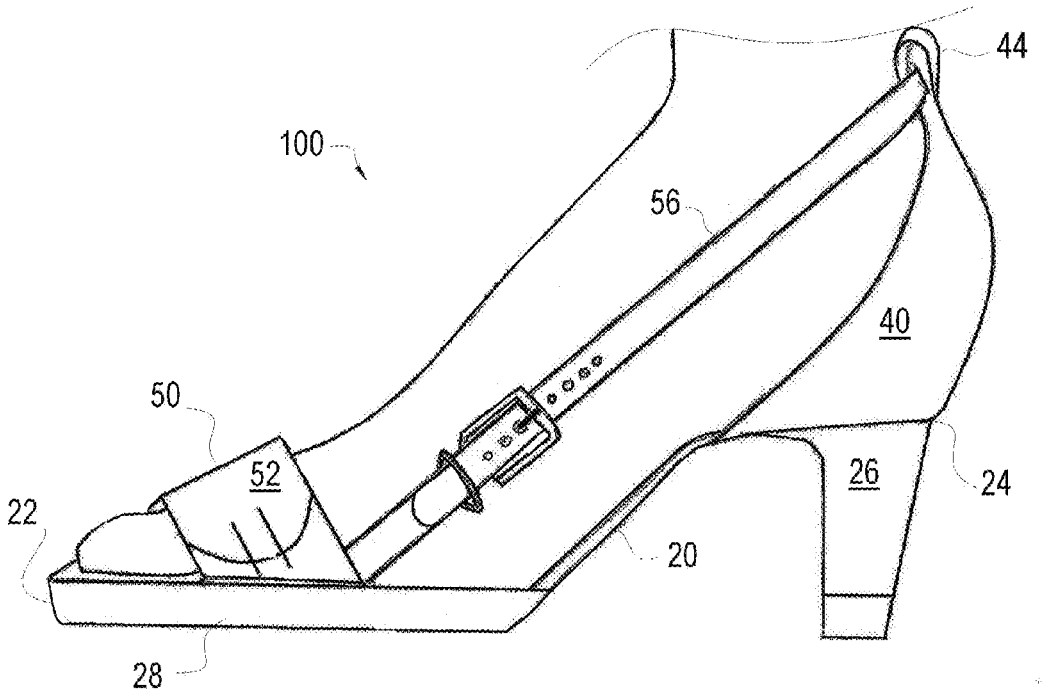
FIG. 5A schematically illustrates a side elevation view of a shoe using one base and one vamp of the shoe wardrobe system according to the present invention.
Figure 5B:
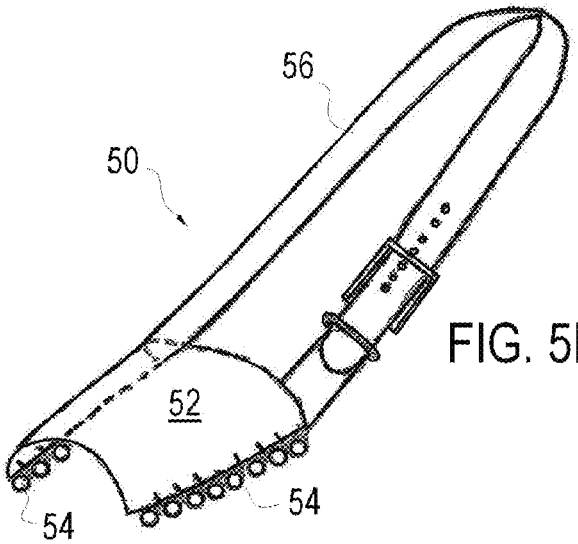
FIG. 5B schematically illustrated a perspective view of a vamp of the shoe of FIG. 5A.

The mechanism with which the front section or vamp 50 is held in place may be understood with reference to figures, specifically FIG. 4B and 8B. In particular, front section 50 comprises a fabric member or top 52. Fabric member or top 52 which forms the front of the shoe 100 is secured by members 54, formed by individual balls sewn to the top 52, forming a ball and chain structure. More particularly the "ball and chain structure" is attached to the bottom edge of the leather or fabric cover that forms removable front section 52 of vamp 50. The "Ball and chain structure" comprises balls and links in the manner of a conventional ball chain used in a variety of applications such as lamp pulls, key-chains and the like, which provide a flexible yet secure attachment mechanism. The "ball and chain structure" of members 54 may be made of steel or any suitable material. As noted above the "ball and chain structure" may be easily secured to bottom edge of cover 52 of vamp 50 by stitching with a thread. The member 54, ball and chain structure, is secured to the base 20 of the shoe 100 by sliding into a channel 32 through opening 34 that is positioned alongside the edges of the front portion of shoe 100.

Each channel 32 is formed with by the support plate 30, such as either by edges as shown in FIG. 4B or slits above channels in FIG. 8B. Support plate 30 is secured to the forward portion of out-sole or sole 28 of base 20, using glue or any other suitable technique, such as stitching through holes provided in plate 30. Support plate 30 may be made up metal or any suitable strong material.

Each channel 32 may be defined by the curled left and right edges of support plate 30 in one embodiment. Channels 32 are configured and dimensioned to slidingly receive ball and chain structure forming members 54, and to retain ball and chain structure of members 54 in place even when it is subjected to relatively strong upward forces, for example those forces associated with walking or other activity. The retention of front section or vamp 50 in place is achieved with the help of frictional force. Such force is present because ball and chain structure forming member 54 is snugly received in each channel 32 and frictionally engaged by the associated channel 32. Each channel 32 is designed to keep the associated engaged member 54 in place so that the front section or vamp 50 stays in place with the help of the frictional force. The gripping action can be improved by making plate 30 of a spring material, such as spring steel and configuring it slightly smaller than the diameter of balls of member 54. Alternatively a detent structure may be added.

The bottom sole or outsole 28, which comes in direct contact with the ground during walking, is preferably made up of either rubber or leather or other material selected for its long wearing characteristic and weatherproof aspects. The enclosed back or counter 40 at the heel end 24 of the shoe 100 supports the heel of the foot of the user and can be made of, for example, plastic, leather or fabric to accommodate the overall design of the shoe 100, or may be omitted (such as a sandal or flat design). A heel support may be positioned underneath the heel 26 of the inventive shoe 100 to serve its typical function.

The height of the heel 26 can be selected from a range of heights, for example high, medium and low or flat as required to meet the needs or desires of a particular user. The heel structure 26 is usually made of plastic or wood with a bottom tip or top lift that is usually made of rubber, or other long wearing and/or shock absorbing material.

An insole 38 is placed upon plate 30 that rests on top of the outsole 28 and is usually made of a soft spongy material such as foam rubber or soft rubber and may include slits 39 aligned with channels 32 as needed.

An exploded view of inventive shoe 100 more clearly illustrates its different elements described above. Base 20 of inventive shoe 100 is secured to and supports enclosed back or counter 40, heel structure 26 and outer sole 28.

Referring to figures, it is seen that the vamp 50, made of fabric for panels 52 is stitched to balls forming members 54 which are held in channels 32 such as may be formed by the curled up edges of plate 30. Insole 38 rests on plate 30, and provides a comfortable support for the wearer of the shoe 100. If desired insole 38 may extend from the front of the shoe 100 to above the heel 26 and secured in place by an adhesive or other suitable material.

Figure 6A:
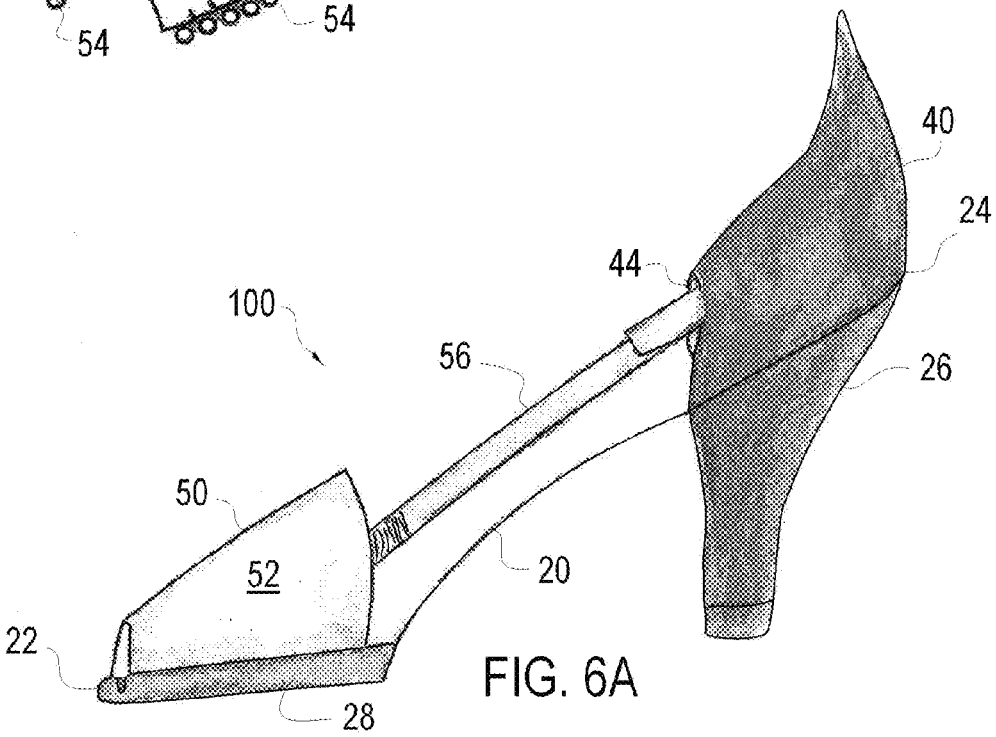
FIG. 6A schematically illustrates a side elevation view of a shoe using one base and one vamp of the shoe wardrobe system according to the present invention.

When it is desired to use a particular inventive shoe 100, the wearer takes in hand the appropriate base 20 (e.g. low medium or high heel 26) comprising base structure (sometimes referred to as the shoe last), which provides the anatomical support for the foot, together with plate 30, insole 38 and heel 26 secured to it. Base 20 is made to be relatively rigid. This allows the user to grasp the vamp 50 and feed ball chain forming member 54 into left channel 32 sliding the balls one after another into the channel 32. Simultaneously, the balls on the right side of vamp 50 are advanced and to right channel 32. The two ball chains of those slid into their respective channels 32, where they are secured on account of being grasped by channels 32. The straps 56 may be looped or secured as appropriate for the shoe 100 design and the shoe 100 may then be put on the foot in conventional fashion and will be retained there during walking, sitting and so forth. FIGS. 6C and D illustrate a shoe 100 with a vamp 50 incorporating a closed toe portion 57 and a lower outer sole engaging front 59 that will cover the openings 34 in channels 32, if desired. The front 59 may be secured to the toe end of the members 54. FIGS. 6C and D are intended to show the shoe of the invention is not limited to open toe designs. There are few limitations on the type of vamps 50 that may be designed and implemented in the invention.

FIG. 7D is an exploded view of an alternative embodiment of the inventive shoe 100 in which the removable top or vamp 50 is secured in place by a member formed by an elongated flexible plastic groove engaging member in place of the ball and chain. The plastic groove engaging member forming member 54 of FIG. 7D also provides an inexpensive and easy to manufacture alternative. Groove engaging member may include a plurality of optional holes through which thread may be used to secure groove engaging member to vamp 50.

While the illustrated embodiments show a vamp 50 with panels largely made of textile material, other materials are also usable to form panels 52 of vamp 50, such as plastic, leather or the like.

Also in contrast to the metal plate 30 of the FIG. 4B one embodiment shown in FIG. 8B forms intake grooves or channels in the sole 28 below slits in plate 30.

In addition to supplying shoes 100 with distinct functional heels 26 the invention preferably provides different vamps 50, for example in different materials, colors and decorations, some designs are shown for illustrative purposes, to be carried by the user, for example in the user's carry-on baggage onto an airplane with a minimal amount of weight and volume. As discussed above the tote 12 allows the system 10 to be easily and effectively carried and shipped as a unit by the user, or the retailer or the manufacturer. Additionally where compartments 14 and 16 are releasably coupled to each other such that new ones may be added, the tote allows for easy expansion of the carrying/storage and shipping system.

Referring to the added straps 56 secured to vamp 50 for selected design, as discussed above additional security is provided by a strap 56 permanently secured to vamp 50 with the strap 56 selectively secured to counter 40 via loops 44. The strap 56 may include a buckle or any suitable fastening device such as hook and loop type fastener secured at the ends. In use, a user feeds strap 56 through a loop 44 at the top of counter 40, or on the sides. The user then pulls strap 56 to a desired length. Once the desired length is reached, the user secures strap via the buckle or hook and loop type fastener attachments.

While illustrative embodiments of the invention have been described, it is apparent that many variations to the present invention may be made without departing from the spirit and scope of the invention. The present invention is defined by the appended claims and equivalents thereto.

What is claimed is:

1. A compact shoe wardrobe system comprising:

a) a plurality of bases, wherein each base includes a forward portion terminating at a toe end, a rear portion terminating at a heel end, wherein said plurality of bases include heels of different heights, and wherein each base includes an outer-sole configured to come into contact with the ground, and a support plate secured atop of the outer-sole on the forward portion of the base, wherein each support plate forms a pair of elongate channels defined on opposed side edges of the support plate, and an access opening on one end of the elongate channels and wherein the elongate channels are closed on the opposed end; and b) a plurality of distinctly styled vamps configured to overlie the instep of the user and configured to be selectively coupled to each base, each vamp including a pair of elongate channel-engaging members on the sides of the vamp, each channel engaging member configured to slide into and mate with a respective one of the elongate channels of an associated base, wherein each said elongate channel-engaging member is stitched to the side of the vamp and wherein said elongate channel-engaging members each include a series of separate ball members each secured to the side of the vamp.

2. A compact shoe wardrobe system according to claim 1, wherein the bases include at least one pair of flats, at least one pair of high heels and at least one pair of intermediate heels.

3. A compact shoe wardrobe system according to claim 2, wherein in at least one pair of bases an insole is mounted on top of the support plate to provide cushioning for the foot and also acting as a shock absorber against the forward moving motion of the user.

4. A compact shoe wardrobe system according to claim 1, wherein said support plate of at least one pair of bases comprises a metal plate.

5. A compact shoe wardrobe system according to claim 4, wherein each said metal plate includes curled edges forming said elongate channels.

6. A compact shoe wardrobe system according to claim 1, wherein at least one of the plurality of distinctly styled vamps comprises a flexible member.

7. A compact shoe wardrobe system according to claim 1 further including a flexible tote holding the system, the tote includes a plurality of base compartments each holding a distinct pair of bases, and at least one vamp compartment holding a plurality of the distinctly styled vamps.

8. A compact shoe wardrobe system according to claim 7 wherein the flexible tote is configured to be rolled up for transport of the system.

9. A compact shoe wardrobe system comprising:

a) a plurality of bases, wherein the bases include at least one pair of flats, at least one pair of high heels and at least one pair of intermediate heels, wherein each base includes a forward portion terminating at a toe end, a rear portion terminating at a heel end, and wherein each base includes an outer-sole configured to come into contact with the ground, and a support plate secured atop of the outer-sole on the forward portion of the base, wherein each support plate forms a pair of elongate channels defined on opposed side edges of the support plate, and an access opening on a forward end of the elongate channels and wherein the elongate channels are closed on the opposed rearward end; and b) a plurality of distinctly styled vamps configured to overlie the instep of the user and configured to be selectively coupled to each base, each vamp including a pair of elongate channel-engaging members on the sides of the vamp, each channel engaging member configured to slide into and mate with a respective one of the elongate channels of an associated base, wherein each said elongate channel-engaging member is stitched to the side of the vamp, wherein said elongate channel-engaging members each include a series of separate ball members each secured to the side of the vamp, and wherein said support plate of at least one pair of bases comprises a metal plate; and further including a flexible tote holding the system, the tote includes a plurality of base compartments each holding a distinct pair of bases, and at least one vamp compartment holding a plurality of the distinctly styled vamps.

10. A compact shoe wardrobe system according to claim 9, wherein in at least one pair of bases an insole is mounted on top of the support plate to provide cushioning for the foot and also acting as a shock absorber against the forward moving motion of the user.

11. A compact shoe wardrobe system according to claim 9, wherein each said metal plate includes curled edges forming said elongate channels.

12. A compact shoe wardrobe system according to claim 9, wherein at least one of the plurality of distinctly styled vamps comprises a flexible member.

13. A compact shoe wardrobe system comprising:

a) a plurality of bases, wherein the bases include at least one pair of flats, at least one pair of high heels and at least one pair of intermediate heels, wherein each base includes a forward portion terminating at a toe end, a rear portion terminating at a heel end, and wherein each base includes an outer-sole configured to come into contact with the ground, and a support plate secured atop of the outer-sole on the forward portion of the base, wherein each support plate forms a pair of elongate channels defined on opposed side edges of the support plate, and an access opening on a forward end of the elongate channels and wherein the elongate channels are closed on the opposed rearward end;

b) a plurality of distinctly styled vamps configured to overlie the instep of the user and configured to be selectively coupled to each base, each vamp including a pair of elongate channel-engaging members on the sides of the vamp, each channel engaging member includes a series of separate ball members each secured to the side of the vamp which are configured to slide into and mate with a respective one of the elongate channels of an associated base; and c) a flexible tote holding the system, the tote includes a plurality of base compartments each holding a distinct pair of bases, and at least one vamp compartment holding a plurality of the distinctly styled vamps.

14. A compact shoe wardrobe system according to claim 13 wherein said support plate of at least one pair of bases comprises a metal plate, and wherein the flexible tote is configured to be rolled up for transport of the system.

* * * * *